United States Patent [19]

Kostylev et al.

[11] 4,159,040

[45] Jun. 26, 1979

[54] PNEUMATIC PERCUSSION TOOL

[75] Inventors: Alexandr D. Kostylev; Vladimir P. Boginsky; Boris N. Smolyanitsky; Khaim B. Tkach, all of Novosibirsk, U.S.S.R.

[73] Assignee: Institut Gornogo Dela Sibirskogo Oidelenia Akademii Nauk SSSR, U.S.S.R.

[21] Appl. No.: 840,484

[22] Filed: Oct. 7, 1977

[30] Foreign Application Priority Data

Oct. 27, 1976 [SU] U.S.S.R. ..... 2425236

[51] Int. Cl.[2] ..... E21B 1/06

[52] U.S. Cl. ..... 173/129; 173/136

[58] Field of Search ..... 173/135, 136, 137, 138, 173/129, 91, 92; 91/234

[56] References Cited

U.S. PATENT DOCUMENTS

| | | | |
|---|---|---|---|
| 3,651,874 | 3/1972 | Sudnishnikov et al. | 173/135 |
| 3,705,633 | 12/1972 | Sudnishnikov et al. | 173/137 |
| 3,744,576 | 7/1973 | Sudnishnikov et al. | 173/137 |
| 4,070,948 | 1/1978 | Tkach et al. | 173/136 |

FOREIGN PATENT DOCUMENTS

| | | | |
|---|---|---|---|
| 259839 | 6/1964 | Netherlands | 173/129 |

*Primary Examiner*—Robert A. Hafer

*Attorney, Agent, or Firm*—Robert E. Burns; Emmanuel J. Lobato; Bruce L. Adams

[57] ABSTRACT

A distinguishing feature of the present invention consists in that the mechanism for driving in rod-shaped elements into compact or frozen ground comprises a guide tube to accommodate said rod-shaped element. The tube extends throughout the length of the shell and is secured in the extension and the front portion of said shell, coaxially with the stepped ram and the shell. The outer surface of said guide tube contacts the inner surface of the axial hole in the stepped ram and has at least one channel which puts the rear and front working chambers in communication with each other when the stepped ram is in the foremost position, while the front portion of the shell is provided with a rigidly secured clamp for holding the rod-shaped element.

2 Claims, 3 Drawing Figures

PNEUMATIC PERCUSSION TOOL

BACKGROUND OF THE INVENTION

The present invention relates to construction engineering and more particularly, to pneumatic percussion tools for driving in rod-shaped elements.

The present invention will be most useful for driving into the ground grounding electrodes, anchor piles, etc. i.e. such rod-shaped elements whose cross section is small in comparison with their length.

Known in the art are several types of mechanisms for driving rod-shaped elements into the ground.

Known in the prior art is a hydraulic mechanism for driving rod-like grounding electrodes into the ground. This mechanism consists of a hydraulic power cylinder with a piston on both sides of which there is a hollow rod receiving the electrode being driven in. Mounted in the upper portion of the cylinder coaxially with the rod is a guide provided with a spiral slot throughout its length, said spiral slot having a steep pitch. On the external surface of the rod there is a fixed pin entering the spiral slot of the guide. Rigidly fixed to the lower free end of the rod is a self-wedging clamp. The shell of the power cylinder is secured by clamps to the mast of an electric transmission line or to the frame of a construction mechanism, e.g. a tractor. The service fluid can be supplied into the upper or the lower space of the hydraulic power cylinder.

At the initial stage of operation the rod is lifted to the upper position and the electrode is interted into it to bear against the ground. Then the fluid is fed into the upper space of the cylinder and the piston goes down together with the rod. Meanwhile, the clamp holds the electrode rigidly so that the latter moves down together with the rod. Going down, the pin slides through the spiral slot of the guide and imparts additional rotary motion to the rod and electrodes. As the piston reaches the lower position, the fluid starts entering the lower space and raises the rod. The clamp releases the electrode and goes up with the rod without the electrode. Upon reaching the uppermost position the rod again starts forcing the electrode down.

A disadvantage of the prior art hydraulic mechanism resides in its large size and in the necessity for fastening it to a solid support or to the frame of a construction mechanism. Besides, driving of rods into a solid or frozen ground by this mechanism is either difficult or altogether impossible due to a static nature of the load applied to the rod being driven in.

Also known in the prior art are rotary mechanisms for screwing rod-shaped elements into the ground, for example a hand-operated mechanism based on an electric drill. This mechanism consists of an electric drill with a reduction unit whose high-speed shaft is connected with the drill shaft. The low-speed shaft of the reduction unit is hollow and carries a self-wedging clamp on its lower end. Fastened in the upper portion of the reduction unit, coaxially with a low-speed shaft is a housing in the form of a tube.

The electrode is inserted into the housing, passed through the hollow low-speed shaft and the clamp. Then the electric drill is switched on. Rotation is transmitted from the electric drill via the reduction unit and the self-wedging clamp to the electrode. The force for driving in the electrode is built up by hand. As soon as the clamp reaches the ground surface the drill is switched off, moved up along the electrode and the screwing motion is resumed.

A disadvantage of this prior art mechanism resides in that the driving-in force is built up by hand which denies the possibility of attaining strong driving-in forces. Besides, this mechanism is not adapted for driving electrodes into solid and frozen soils.

Another prior art pneumatic percussion tool is intended to drive rod-shaped elements into the ground. This mechanism comprises a shell with a clamp rigidly fixed in its front portion. Located inside the shell with a provision for axial reciprocation is a stepped ram. The tail end of the shell is closed by an extension which has air admission and discharge holes. The stepped ram together with the shell forms the front working chamber while together with the extension it forms the rear working chamber. The rear working chamber is in constant communication with compressed air supply whereas the front working chamber is put periodically in communication with the rear working chamber and the atmosphere.

The percussion mechanism is secured by the clamp to the upper end of the rod-shaped element. When the compressed air supply is turned on, the stepped ram starts reciprocating and deals blows to the front portion of the shell. Under the effect of these blows conveyed through the shell and the clamp, the rod-shaped element penetrates into the ground.

A disadvantage of the known pneumatic percussion mechanism resides in that it is adapted for striking only the butt end of the rod-shaped element which denies the possibility of driving in rod-shaped elements whose cross section is infinitely small in comparison with their length because they are distorted in the process of being driven in.

Another prior-art pneumatic percussion mechanism comprises a hollow cylindrical shell with an extension and a front portion accommodating an axially-reciprocating stepped ram.

The small-diameter step of the ram interacts with the extension, the butt end of said ram forming with said extension a rear variable-volume working chamber which is in constant communication with compressed air supply. In the front portion of the shell the stepped ram forms a front variable-volume working chamber which communicates through the axial hole of the stepped ram with the rear working chamber when the ram is in the foremost position and with the atmosphere through the longitudinal channels on the external surface of the large-diameter step of the ram when the latter is in the rearmost position. The stepped ram strikes the shell as it reciprocates in the shell under the force of compressed air fed into the working chambers. The stepped ram moves owing to the difference in its areas at the sides of the front and rear working chambers subjected to the pressure of compressed air.

A disadvantage of the known pneumatic percussion mechanism consists in that the percussion mechanism is secured in the upper portion of the rod-shaped element for driving it into the ground. The rod-shaped element penetrates into the ground under the force of the blows dealt to its butt end. Therefore, the known percussion mechanism is not suitable for driving in rod-shaped elements whose cross section is infinitely small in comparison with their length since said elements are apt to be distorted in the course of the driving-in process.

SUMMARY OF THE INVENTION

The main object of the present invention is to permit the rod-shaped elements whose cross section is infinitely small in comparison with their lengths to be driven into solid and frozen soils.

Another object of the invention is to reduce the mass and size of the tool.

Still another object of the invention is to improve the reliability of the tool.

A further object of the invention is to simplify the design of the tool.

These and other objects are accomplished by providing a pneumatic percussion tool for driving in rod-shaped elements comprising a hollow cylindrical shell with an extension and a front portion, said shell accommodating an axially-reciprocating stepped ram whose small-diameter step interacts with the extension so that the butt end of said ram and said extension form a rear variable-volume working chamber constantly communicating with compressed air supply while in the front portion of the shell said ram forms a front variable-volume working chamber which communicates with the rear working chamber through an axial hole in the stepped ram when the latter is in the foremost position, and with no atmosphere through longitudinal channels on the external surface of the large-diameter step of the ram when the latter is in the rearmost position so that the compressed air fed into the working chambers reciprocates said ram which strikes the shell wherein, according to the invention, said tool incorporates a guide tube intended to accommodate a rod-shaped element. The tube extends throughout the length of the shell and is secured coaxially with the stepped ram and shell in its extension and front portion so that the outer surface of said guide tube contacts the inner surface of the axial hole in the stepped ram and has at least one channel which puts the rear working chamber in communication with the front working chamber when the stepped ram is in the foremost position and wherein the front portion of the shell is provided with a rigidly fixed clamp for holding the rod-shaped element.

It is also expedient that the channel on the external surface of the guide tube should be made in the form of a circular recess.

Such a design of the pneumatic percussion tool permits the rod-shaped element whose cross section is infinitely small in comparison with its length to be passed through the guide tube and the tool to be fixed at such a distance from the end of the rod-shaped element which rules out its distortion while it is being driven into the ground.

BRIEF DESCRIPTION OF THE DRAWINGS

Now the invention will be described in detail by way of example with reference to accompanying drawings in which.

DISCRIPTION OF THE PREFERRED EMBODIMENT

Figure 2:
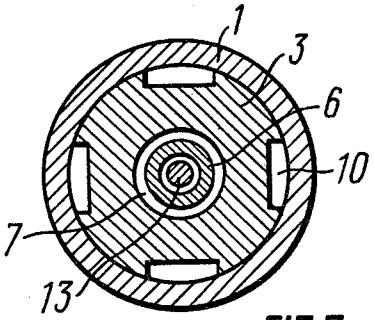
FIG. 2 is a section taken along line II—II in FIG. 1.
Figure 3:
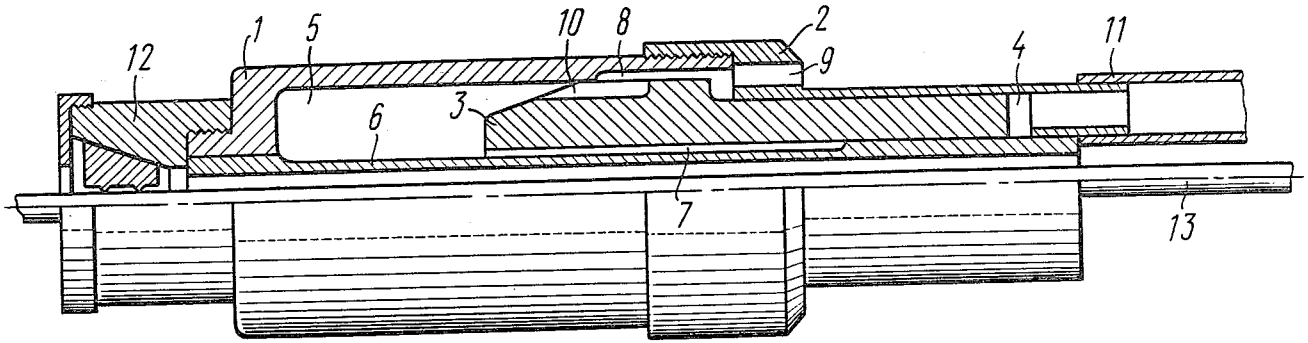
FIG. 3 illustrates the pneumatic percussion tool according to the invention with the stepped ram in the rearmost position, with a partial longitudinal section.

The pneumatic percussion tool (FIGS. 1, 2, 3) according to the invention comprises a hollow cylindrical shell 1 with an extension 2 and a front portion. The extension 2 is made in the form of a stepped bushing fixed by a threaded joint in the end portion of the shell 1 and closing the inner space of the shell 1. Reciprocating axially inside the shell 1 is a stepped ram 3. The small-diameter step of the ram 3 is accommodated in the axial hole of the extension 2 so that its external surface interacts with the internal surface of the axial hole in the extension 2. The large-diameter step of the ram 3 is located nearer to the front portion of the shell 1 and its external surface interacts with the internal surface of the shell 1.

Figure 1:
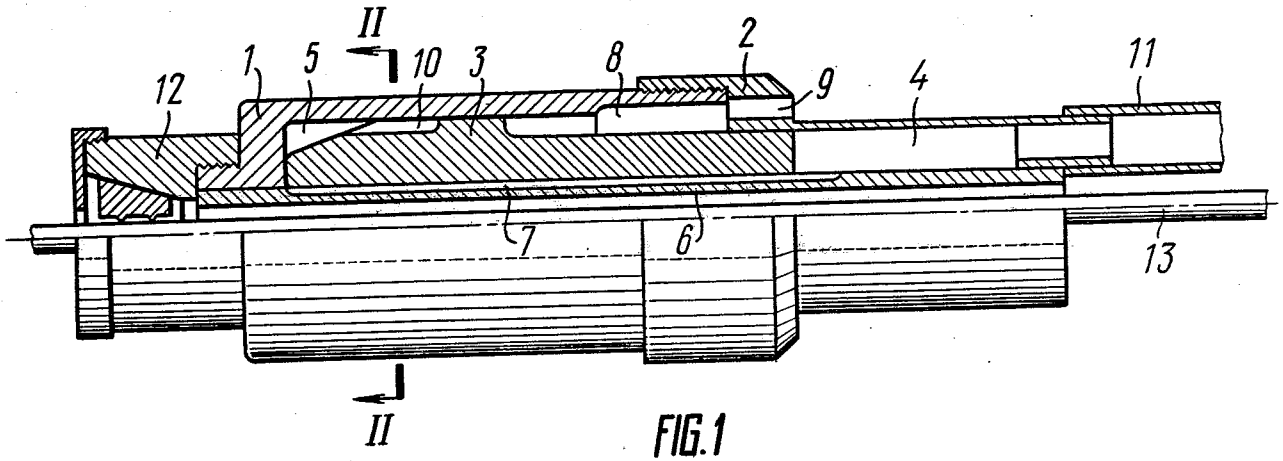
FIG. 1 illustrates the pneumatic percussion toll according to the invention with the stepped ram in the foremost position, with a partial longitudinal section.

The stepped ram 3 occupying the foremost position (as shown in FIG. 1) forms a rear variable-volume working chamber 4 in the shell 1 at the side of the extension 2. The chamber 4 is formed by a face surface of the small-diameter step of the ram 3 and by the internal surface of the axial hole in the extension 2. The rear working chamber 4 is in constant communication with compressed air supply (not shown in FIG. 1).

At the side of the front portion of the shell the ram forms a front variable-volume working chamber 5. This chamber 5 is formed by the surface of the large-diameter step of the ram 3 facing the front end of the shell 1 and by the internal surface of the shell 1.

The stepped ram 3 has an axial hole accommodating a guide tube 6 which receives the rod-shaped element to be driven in. The guide tube 6 is arranged coaxially with the stepped ram 3 and the shell 1, extends throughout the length of the shell 1 and is secured in the extension 2 and in the front portion of the shell 1. The outer surface of the guide tube 6 contacts the inner surface of the ram 3.

The outer surface of the guide tube 6 has a channel 7 which puts the rear working chamber 4 in communication with the front working chamber 5 when the stepped ram 3 is in the foremost position.

The internal surface of the shell 1 at the side of the extension 2 has a recess 8 which is vented to the atmosphere through discharge holes 9 in the face wall of the extension 2.

The external surface of the large-diameter step of the ram 3 has longitudinal channels 10 which communicate the front working chamber 5 with the recess 8 and the atmosphere when the stepped ram is in the rearmost position.

Compressed air is supplied into the working chambers 4, 5 through a hose 11 secured on the extension 2.

A clamp 12, e.g. of the collet type, rigidly fixed on the front portion of the shell 1 is intended to hold the rod-shaped element 13.

The pneumatic percussion tool functions as follows.

The rod-shaped element 13 is passed through the guide tube 6. Then the pneumatic percussion tool is fastened by the clamp 12 on the rod-shaped element 13 at such a distance from its lower end which would rule out distortion of the element in the course of driving in. Then the rod-shaped element 13 is set to the initial position for driving in and the air-distributing cock (not shown in FIGS. 1, 2, 3) is turned on to supply compressed air into the working chambers 4, 5.

When the stepped ram 3 is in the foremost position shown in FIGS, 1, 2, the compressed air flows from the rear working chamber 4 through the channel 7 into the front working chamber 5. Here the air pressure becomes practically the same as in the rear working chamber 4. Inasmuch as the surface area of the stepped ram 3 subjected to the pressure of compressed air from the side of the front working chamber 5 is larger than the surface area of the stepped ram 3 subjected to the air pressure from the side of the rear working chamber 4, the stepped ram 3 starts moving towards the extension 2.

As soon as the channel 7 is covered by the inner surface of the axial hole in the stepped ram 3, further movement of the stepped ram 3 continues due to the energy of the air expanding in the front working chamber 5.

When the stepped ram 3 (FIG. 3) occupies the rearmost position, its longitudinal channels 10 open into the recess 8 of the shell 1 and the air is discharged from the front working chamber 5 into the atmosphere through the longitudinal channels 10 and the discharge holes 9.

The pressure of air in the front working chamber 5 drops to the atmospheric pressure level, the stepped ram 3 stops in the rearmost position (FIG. 3) and, being acted upon by the compressed air contained in the rear working chamber 4, starts moving towards the front portion of the shell 1 and strikes the latter. Before the blow, the channel 7 of the guide tube 6 opens and puts the front working chamber 5 in communication with the rear working chamber 4.

Under the effect of the blows dealt to the front portion the shell 1, the rod-shaped element 13 rigidly connected with the shell 1 penetrates into the ground. As soon as the clamp 12 of the pneumatic percussion tool reaches the ground surface, the supply of compressed air to the working chambers 4, 5 is discontinued and the clamp 12 is removed from the rod-shaped element 13.

Then the pneumatic percussion tool is shifted upward over the rod-shaped element 13, secured on the latter, and the driving-in process is resumed.

As distinct from the known penumatic percussion tools, the tool according to the invention permits driving in the rod-shaped elements whose cross section is infinitely small in comparison with their length, because the blows are struck at the point which rules out distortion of the rod-shaped element.

We claim:

1. A pneumatic percussion tool comprising, a tubular annular casing having an axial bore for receiving a rod therethrough to be axially driven, a clamp fixed to said casing for releasably securing the casing onto said rod for driving it, a percussion hammer driven reciprocably in said casing extending axially in said casing and having an annular cross section and an intermediate portion having a major diameter intermediate opposite ends thereof, a front working chamber in said casing defined by a leading end of said hammer and said casing, a rear extension axially of said casing defining an annular rear working chamber constantly under air pressure, means defining a passageway extending between the rear working chamber and the front working chamber, said front end and intermediate portion having a larger working area than a working area defined by said intermediate portion and a rear end of said percussion hammer, whereby when said percussion hammer is in a forward position air under pressure in said rear working chamber passes through said passageway into said front working chamber and moves said percussion hammer toward said rear partially into said rear working chamber, said passageway having an inlet port disposed to be closed by said percussion hammer before it reaches a rearmost position of travel thereof, said casing having an annular chamber at a rear end thereof open to the atmosphere and greater diameter than said major diameter, whereby as said intermediate portion with said major diameter is in axial registry with said annular chamber said front working chamber is vented to the atmosphere and said percussion hammer is driven forwardly to impact said casing and drive it in a direction forwardly thereby to drive said rod axially forwardly, and as said percussion hammer moves forwardly it uncovers said port so that as said hammer moves to its forward position it is returned to its rear position and is reciprocably driven by said air under pressure.

2. A pneumatic percussion tool according to claim 1, in which both said front working chamber and said rear working chamber are annular.

* * * * *